US011446213B2

(12) United States Patent
Lee

(10) Patent No.: US 11,446,213 B2
(45) Date of Patent: Sep. 20, 2022

(54) TEETHING GROWTH DEVICE HAVING WRIST BAND

(71) Applicant: Seokjin Lee, Yangju-si (KR)

(72) Inventor: Seokjin Lee, Yangju-si (KR)

( * ) Notice: Subject to any disclaimer, the term of this patent is extended or adjusted under 35 U.S.C. 154(b) by 573 days.

(21) Appl. No.: 16/481,712

(22) PCT Filed: Nov. 15, 2017

(86) PCT No.: PCT/KR2017/012972
§ 371 (c)(1),
(2) Date: Jul. 29, 2019

(87) PCT Pub. No.: WO2018/159924
PCT Pub. Date: Sep. 7, 2018

(65) Prior Publication Data

US 2019/0388304 A1 Dec. 26, 2019

(30) Foreign Application Priority Data

Feb. 28, 2017 (KR) ..... 10-2017-0026653
Sep. 15, 2017 (KR) ..... 10-2017-0118316

(51) Int. Cl.
*A61J 17/02* (2006.01)
*A44C 5/00* (2006.01)
(Continued)

(52) U.S. Cl.
CPC ..... *A61J 17/02* (2013.01); *A44C 5/0023* (2013.01); *A44C 5/2076* (2013.01); *A61J 17/111* (2020.05)

(58) Field of Classification Search
CPC ..... A61J 17/00; A61J 17/001; A61J 17/02; A61J 17/10; A61J 17/101–113; A61J 17/1115; A44C 5/0023
See application file for complete search history.

(56) References Cited

U.S. PATENT DOCUMENTS 2,798,482 A * 7/1957 Feeney ..... A61J 17/02 128/880
2008/0047988 A1* 2/2008 Hurd ..... A45F 5/00 224/267

(Continued)

FOREIGN PATENT DOCUMENTS

CN 206238610 U * 6/2017
KR 200237227 Y1 10/2001

(Continued)

OTHER PUBLICATIONS

Translation by LinguaLing Language Solutions, Inc. for: Naver blog post, With Wrist-Worn Baby Teether. Mama's TEM JemJem Glove is Sufficient. Feb. 3, 2017, pp. 1-12, Naver Corp, Seongnam-si, Republic of Korea. (Year: 2017).*

(Continued)

*Primary Examiner* — Katherine M Shi
(74) *Attorney, Agent, or Firm* — STIP Law Group, LLC

(57) ABSTRACT

The present invention comprises: a wrist band part wound around a wrist of a baby; a body part which extends from the wrist band part to allow the baby to suck or chew the body part and has an inner space for receiving a hand of the baby; and a grip part, both ends of which are in contact with the body part so that the grip part extends across the inner space of the body part wherein, for storage, when the wrist band part is supported on the ground, the body part is vertically erected with respect to the ground without being tilted by self-weight thereof.

4 Claims, 7 Drawing Sheets

(51) Int. Cl.
*A44C 5/20* (2006.01)
*A61J 17/00* (2006.01)

(56) References Cited

U.S. PATENT DOCUMENTS

| | | | | |
|---|---|---|---|---|
| 2009/0059734 | A1* | 3/2009 | Burton | G04G 17/08 368/294 |
| 2015/0033795 | A1* | 2/2015 | Kim | A44C 5/2047 63/3.1 |
| 2015/0245981 | A1* | 9/2015 | Barber | A61J 17/00 606/235 |
| 2016/0184186 | A1* | 6/2016 | Montini | A61J 17/001 606/235 |
| 2017/0231335 | A1* | 8/2017 | Montaquila | A44C 15/0085 63/3.1 |
| 2018/0055741 | A1* | 3/2018 | Hyslop | A41D 19/0024 |

FOREIGN PATENT DOCUMENTS

| | | | |
|---|---|---|---|
| KR | 1020120052114 | A | 5/2012 |
| KR | 200474945 | Y1 | 10/2014 |

OTHER PUBLICATIONS

Translation by LinguaLing Language Solutions, Inc. for: Naver blog post, Purchase New Mama's TEM Teether Product! JemJem Glove vs JemJem Monster, Nov. 4, 2016, pp. 1-5, Naver Corp, Seongnam-si, Republic of Korea (Year: 2016).*

Translation by LinguaLing Language Solutions, Inc. for: Naver blog post, Considering Baby Teethers: Mamas TEM JemJem Glove or Mama's TEM JemJem Monster, Nov. 30, 2016, pp. 2-9, Naver Corp, Seongnam-so, Republic of Korea (Year: 2016).*

International Search Report of PCT/KR2017/012972, dated Feb. 19, 2018, English translaion.

Naver blog post, Purchase New Mama's TEM Teether Product ! JemJem Glove vs JemJem Monster, Nov. 4, 2016 ,pp. I-5, Naver Corp, Seongnam-si, Republic of Korea.

Naver blog post, Considering Baby Teethers: Mamas TEM JemJem Glove or Mama's TEM JemJem Monster, Nov. 30, 2016, pp. 2-9, Naver Corp, Seongnam-si, Republic of Korea.

Naver blog post, With Wrist-Worn Baby Teether. Mama's TEM JemJem Glove is Sufficient, Feb. 3, 2017, pp. I-12, Naver Corp, Seongnam-si, Republic of Korea.

Naver blog post, Tiaeri Baby Rattle Gift Sec for a Newborn's First Toy, May 11, 2014, pp. 2-3, Naver Corp, Seongnam-si, Republic of Korea.

* cited by examiner

[FIG. 1]
-- PRIOR ART --
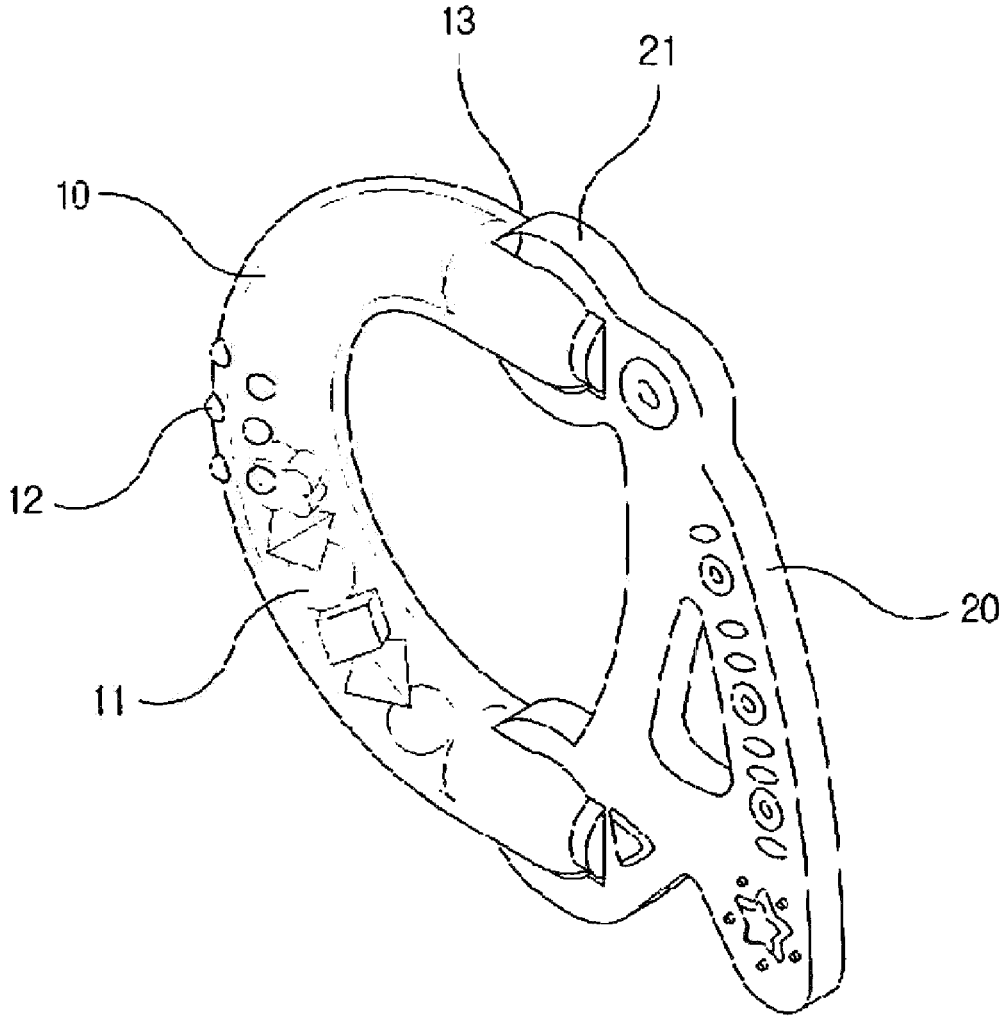

[FIG. 2]
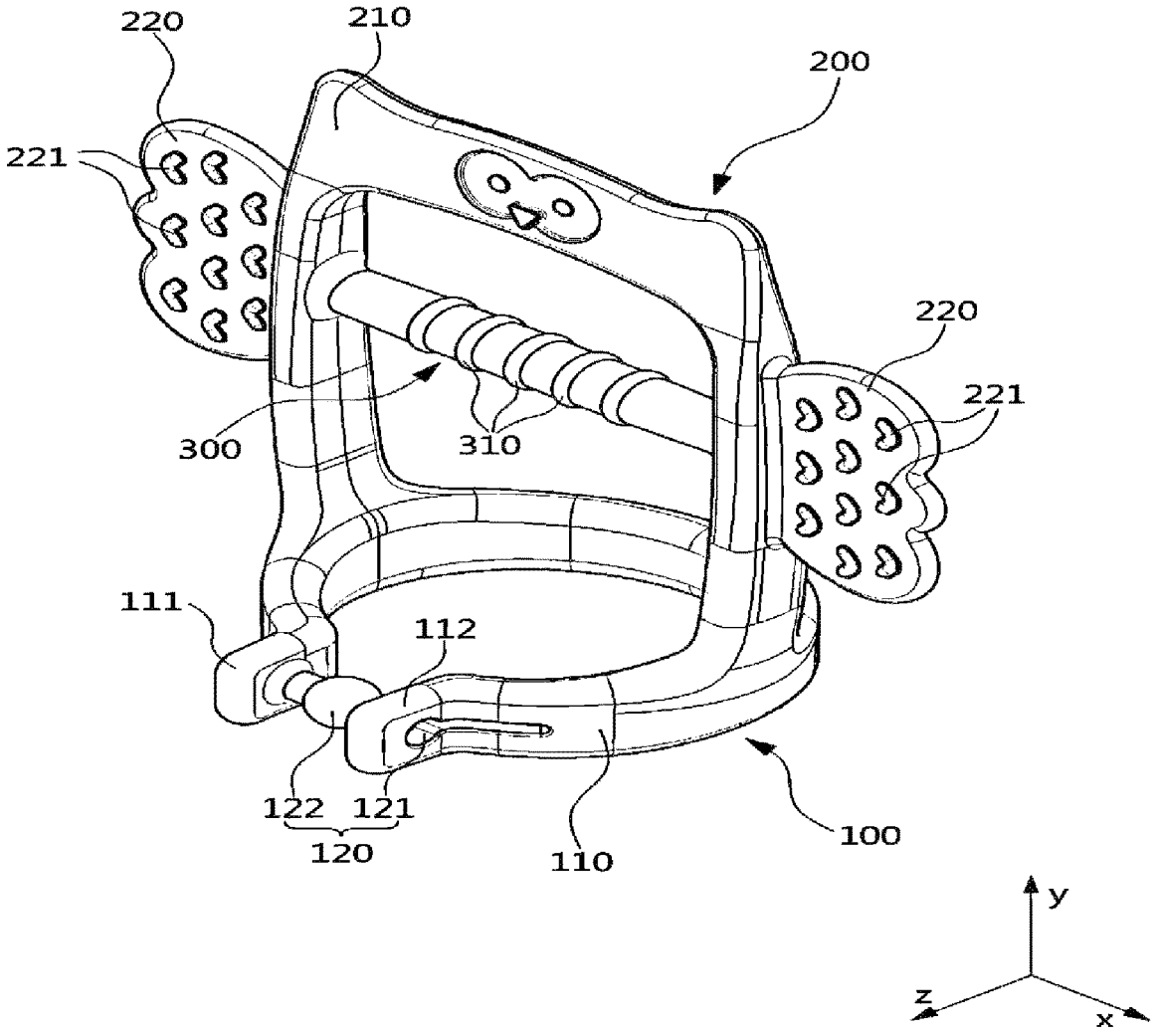

[FIG 3]
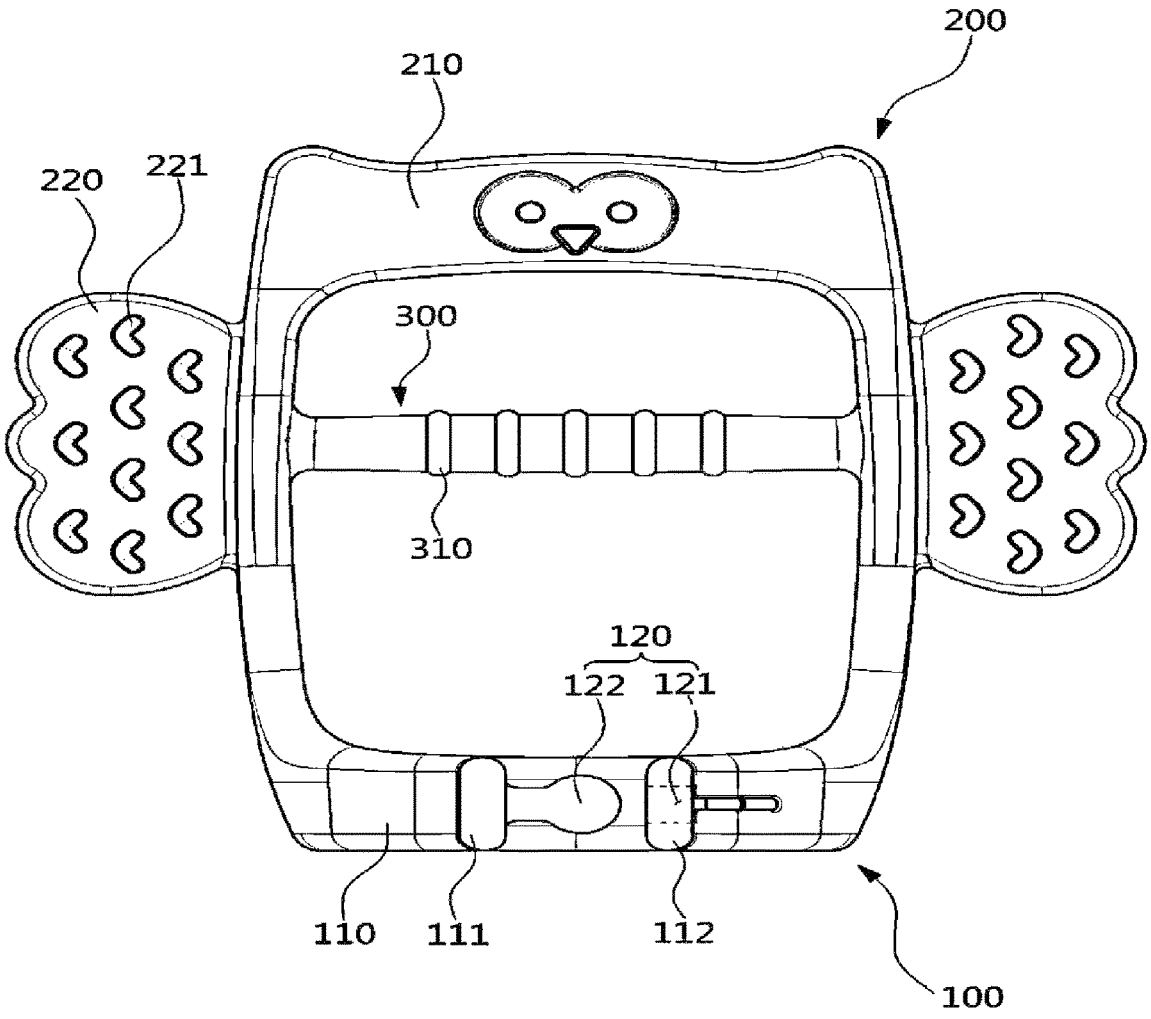

[FIG. 4]
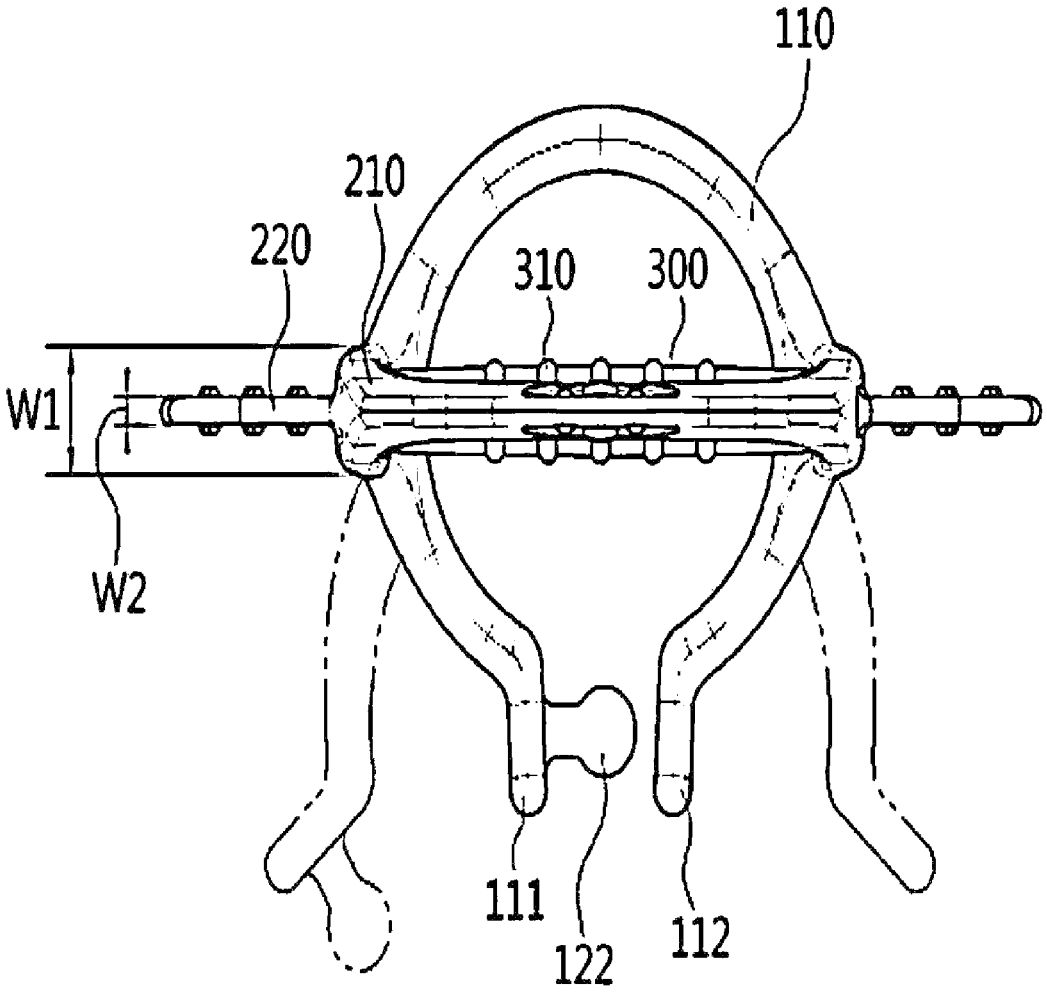

[FIG. 5]
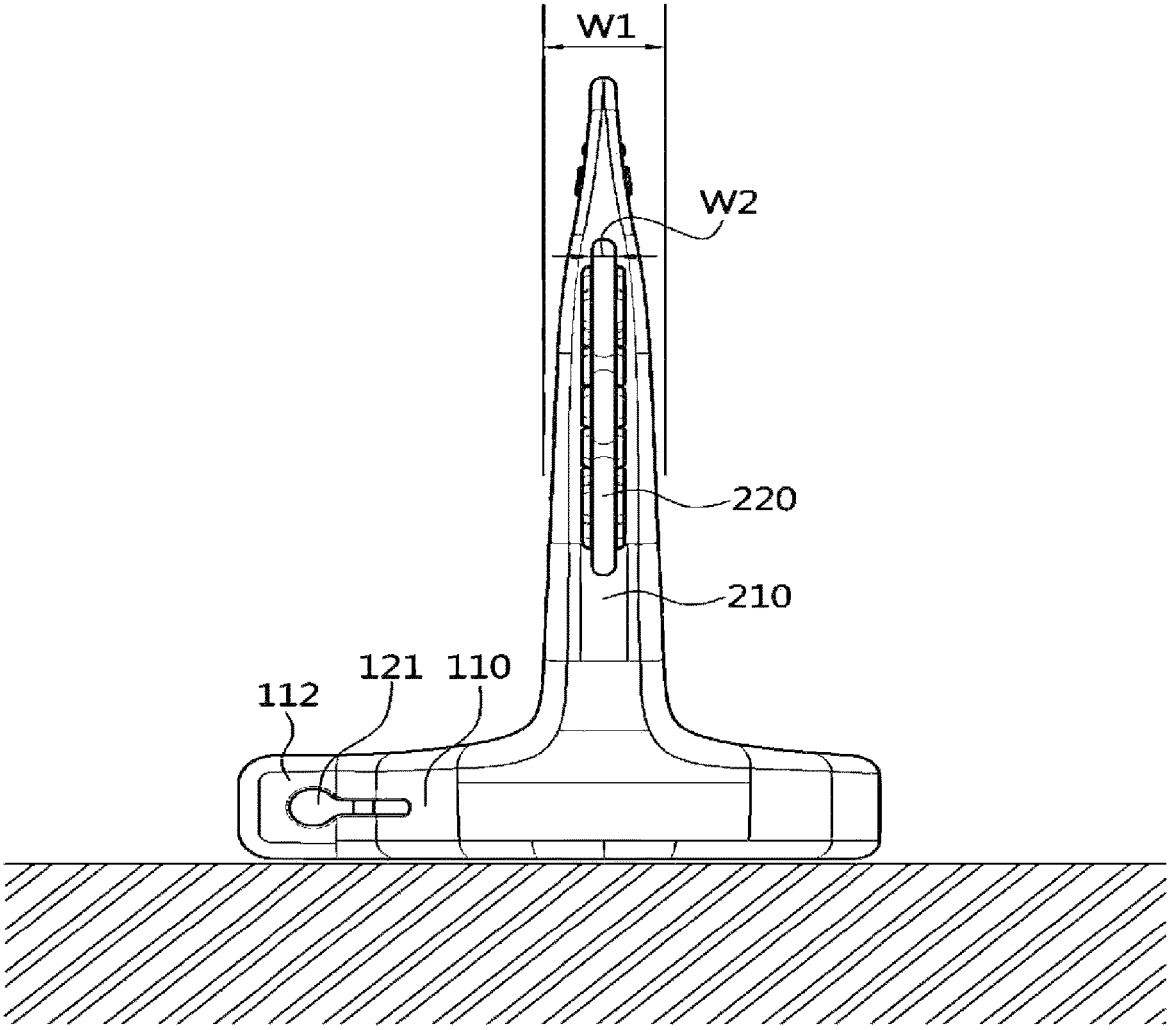

[FIG. 6]
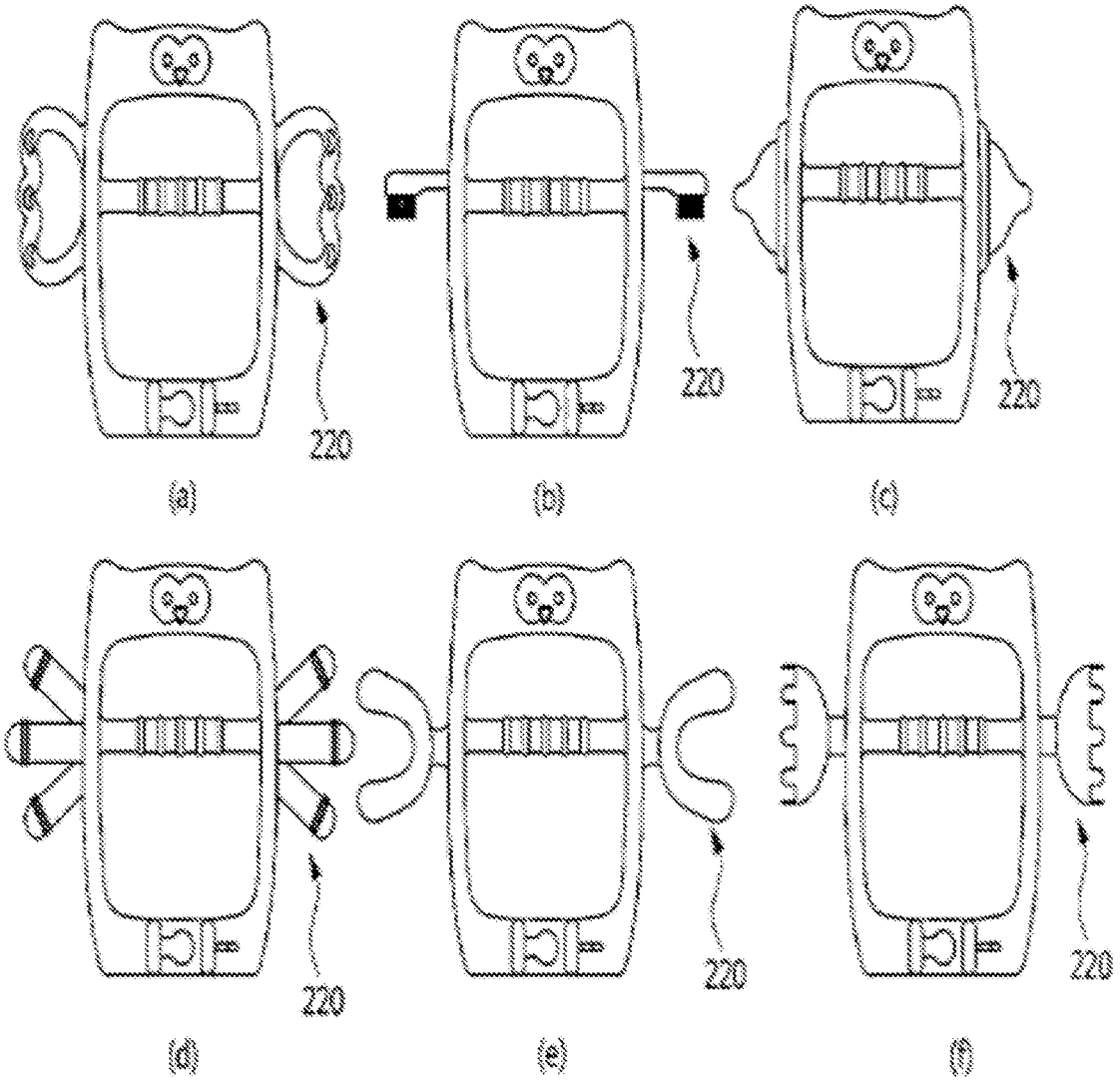

[FIG. 7]
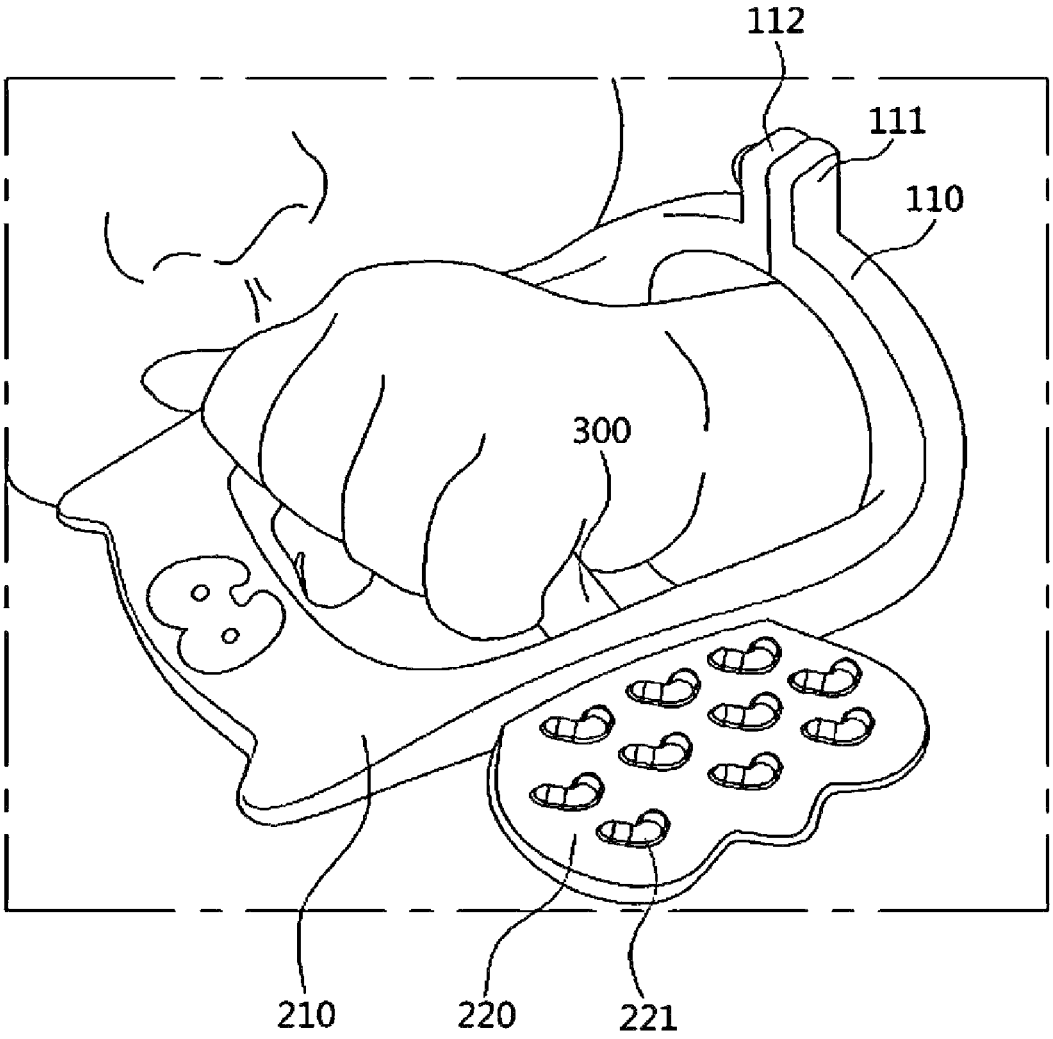

TEETHING GROWTH DEVICE HAVING WRIST BAND

CROSS-REFERENCE TO RELATED APPLICATIONS

This application is the U.S. National Phase under 35 U.S.C. § 371 of International Application No. PCT/KR2017/012972 filed on Nov. 15, 2017, which in turn claims the benefit of Korean Applications No. 10-2017-0026653 filed on Feb. 28, 2017 and 10-2017-0118316 filed on Sep. 15, 2017, the disclosures of which are incorporated by reference into the present application.

TECHNICAL FIELD

The present disclosure relates to a teething growth device provided with a wrist band, and more particularly, to a teething growth device which is used in the oral stage, in which teeth of babies start erupting, to satisfy the babies' desires to chew, to prevent babies from sucking their fingers, and to solve the problem of itchy gums, and can be easily worn on and removed from a baby's wrist and is erected for storage such that it can be managed sanitarily.

BACKGROUND ART

The deciduous teeth appear from lower central incisors between 6 and 10 months of age after birth, and it takes about 2 years for a set of teeth to be completed. Teeth are not seen in the mouth at birth, but many teeth are encased in the jaw bone before birth and sequentially appear at appropriate time. Babies may feel pleasure in stimuli to the periphery of the mouth, such as lips, tongue, gums, etc., during the stage in which the deciduous teeth start erupting, and this stage is referred to as the oral stage. That is, sucking, chewing, biting, or the like in this oral stage may be very important factors in giving babies pleasure. Accordingly, if a stimulus is given to the periphery of the mouth, instinctive energy may be released and tension may be relieved.

A normal teething growth device refers to a device that is used as a toy to be chewed by baby's mouth in order to satisfy the babies' desires to chew during the above-mentioned oral stage and to induce visual, tactile, and intelligent body development and teeth growth.

Such a related-art teething growth device is disclosed in Korean Patent Laid-Open Publication No. 10-2012-0052114 (titled "Teething ring having improved structure"). This device will be described briefly hereinbelow.

As shown in FIG. 1, the related-art teething growth device has a handle 10 to be gripped by a baby's hand, and a chewing part which is coupled to an end of the handle and is replaceable, and is configured to allow a baby to grip the handle 10 with baby's hand and then to put the chewing part 20 into baby's mouth and to chew and suck it.

However, the related-art teething growth device may have the following problems:

First, a baby who is insensitive to feeling on his/her hand may not easily grip the handle 10, and, even if the baby grips the handle 10, there may be a problem that the handle 10 easily slips from the hand due to a weak gripping force.

In addition, the related-art teething growth device may have a problem that it slips from baby's hand due to bodily secretions such as saliva or babies cannot easily grip the device due to their weak gripping force. In addition, when the related-art teething growth device slips from baby's hand, the device comes into contact with the ground and may be contaminated by germs or the like. Since the chewing part 20 is always in contact with the ground when the teething growth device is stored, there may be a difficult in maintaining it sanitarily.

To solve the above-mentioned problems, the present disclosure has enhanced a part of the invention the application of which was previously filed and based on which priority is claimed.

PRIOR ART LITERATURE

Patent Literature (Patent Literation 1) Korean Patent Laid-Open Publication No. 10-2012-0052114

DETAILED DESCRIPTION OF THE PRESENT DISCLOSURE

Technical Objects

The present disclosure has been developed in order to solve the above-mentioned problems of the prior art, and an object of the present disclosure is to provide a teething growth device which is fixed around a baby's wrist, such that it can be prevented from slipping from the baby's wrist due to self-weight thereof, and which is erected for storage such that a chewing part is not in contact with the ground and thus the device can be used sanitarily.

In addition, an object of the present disclosure is to provide a teething growth device which can prevent finger sucking and also can give a stimulus to the periphery of baby's mouth, thereby making the baby feel pleasure.

Technical Solving Method

As a means for achieving the above-described objects, the present disclosure provides a teething growth device provided with a wrist band, the device including: a wrist band part which is wound around a wrist of a baby; a body part which is extended from the wrist band part to be sucked or chewed by the baby, and has an inner space formed therein to allow a hand of the baby to be received therein; and a grip part which has both ends in contact with the body part to be extended across the inner space of the body part, wherein the wrist band part includes a grip ring a part of which is cut out to allow the wrist of the baby to pass therethrough, and the grip ring is extended by elastic deformation to allow the wrist of the baby to be introduced, and returns to its original state by elastic deformation to be kept wound around the wrist.

In addition, the wrist band part may further include a fastening means for fastening or unfastening both ends of the grip ring, and, when the teething growth device is stored, a lower surface of the grip ring may be supported on the ground with an axial line of the grip ring being placed in a vertical direction with respect to the ground, and the body part may not be tilted due to a self-weight thereof and may be vertically erected with respect to the ground.

In addition, the body part may include: a support piece which is extended upward along an axial direction of the grip ring and is formed in the shape of an inverted U; and a protruding piece which is formed on an outer circumference of the support piece and has a plurality of stimulus projections protruding therefrom to stimulate the periphery of baby's mouth.

In addition, a stepped portion may be formed between the protruding piece and the support piece by making a width of the protruding piece in a forward and backward direction smaller than a width of the support piece in the forward and backward direction, to prevent secretions from entering the inner space of the body part.

In addition, both ends of the support piece may be positioned at quadrant points of the grip ring symmetrical to each other.

In addition, the grip part may have a plurality of grip protrusions formed thereon in a longitudinal direction and corresponding to bottom surfaces of fingers when the baby grips the grip part.

In addition, the fastening means may include: one or more fastening recesses formed on one end of the grip ring; and one or more fastening pieces formed on the other end of the grip ring to be inserted into the fastening recess.

Advantageous Effect

The present disclosure has the following effects:

First, since the body part is vertically erected by the wrist band part with respect to the ground, the body part can be prevented from being in contact with the ground and being contaminated when being stored, and thus can be stored sanitarily. Since the body part is not in contact with the ground and is not contaminated, there is an effect that an additional cleaning operation is omitted when the teething growth device is re-used.

Second, since the wrist band part is wound around the baby's wrist when the teething growth device is used, the wrist band part always grips the baby's wrist even when the teething growth device slips due to a weak gripping force. Therefore, the teething growth device can be prevented from falling down to the ground and being contaminated. In addition, since the teething growth device is always wound around the baby's wrist when the baby goes out with the parent, there is an effect that the teething growth device can be prevented from being lost in advance even when the baby is in a moving means such as a baby carriage and is out of the parent's view.

Third, since the grip ring has a part on a path cut out, the grip ring can allow the wrist of the baby to pass therethrough without interference. The grip ring can be elastically deformed and can be applied without difficulty even when the baby's wrist is relatively thick or increases according to the growth, and furthermore, can be worn on thick clothes. As a result, since there is no need to manufacture the teething growth device in phases according to the thickness of baby's wrist, an inventory can be efficiently managed. Since there is no need to provide a plurality of teething growth devices according to the wrist of a growing baby, and only one teething growth device can be provided, an economical effect can be expected.

Fourth, the baby can stably grip the grip part through the grip protrusions formed on the grip part, and a slip can be minimized when the baby grips the grip part. Therefore, there is an effect that a gripping force can be increased.

Fifth, various stimuli can be provided to the periphery of the baby's mouth through the stimulus projections, and accordingly, baby's pain and itching caused by eruption of the deciduous teeth can be relieved and the baby can receive help in the oral development, and also, there is an effect of intelligence development through the action of gripping the grip part with baby's hand.

Sixth, since the width of the support piece in the forward and backward direction is gradually reduced toward the upper portion, the baby can be provided with various pleasures and tactile sensations when chewing and biting the support piece.

BRIEF DESCRIPTION OF THE DRAWINGS

FIG. 1 is a perspective view illustrating a related-art teething growth device;

FIG. 2 is a perspective view illustrating an overall exterior of a teething growth device according to the present disclosure;

FIG. 3 is a front view illustrating a front surface of the teething growth device according to the present disclosure;

FIG. 4 is a top view illustrating a top of the teething growth device according to the present disclosure;

FIG. 5 is a side view illustrating one side surface of the teething growth device according to the present disclosure;

FIG. 6 is a concept view illustrating various embodiments of a protrusion piece according to the present disclosure; and FIG. 7 is a concept view illustrating a usage state of the teething growth device according to the present disclosure.

BEST MODE FOR EMBODYING THE INVENTION

Hereinafter, preferred embodiments of the present disclosure will be described in detail with reference to the accompanying drawings for full understanding of the present disclosure. The exemplary embodiments may be embodied in many different forms and the scope of the present disclosure should not be construed as limited to the exemplary embodiments set forth herein. The exemplary embodiments are provided so that this disclosure will be thorough and complete, and will fully convey the scope of the application to those of ordinary skill in the art. Accordingly, in the drawings, shapes and etc. of elements may be exaggerated for easy understanding of the present disclosure. It should be noted that the same reference numerals are used for the same elements in the respective drawings. Detailed explanations of well-known functions and constitutions are omitted when it is deemed that they may unnecessarily obscure the essence of the present disclosure.

Prior to describing the present disclosure, a direction reference which is not precise and is rough will be specified with reference to FIG. 2 for convenience of explanation. In the state illustrated in FIG. 2, a vertical axis (y), a horizontal axis (x), and a forward and backward axis (z) are defined and directions are specified according to these axes in the descriptions related to the other drawings.

In addition, it is preferable that all of elements constituting the present disclosure are integrally formed with one another as shown in the drawings, and have curved outer surfaces to minimize stimuli to baby's skin. In addition, the present disclosure may be implemented through various materials, but it is preferable that the elements are formed with synthetic resin, silicon, rubber, or the like which is elastic and is processed sanitarily since it is put into baby's mouth. In this case, the elements may be formed with materials having different degrees of hardness.

That is, a teething growth device according to the present disclosure is characterized in that it can be used stably due to a simple integrated structure, is formed with a single material such that it can be managed sanitarily, and minimizes a radius of slipping from baby's hand, such it can be prevented from being contaminated with foreign substances. However, it should be noted that the teething growth device is formed with a composite material in which silicon, rubber, synthetic resin, etc. are mixed.

FIG. 2 is a perspective view illustrating an overall exterior of a teething growth device according the present disclosure, FIG. 3 is a front view illustrating a front surface of the teething growth device according to the present disclosure, FIG. 4 is a top view illustrating a top of the teething growth device according to the present disclosure, FIG. 5 is a side view illustrating one side surface of the teething growth device according to the present disclosure, FIG. 6 is a concept view illustrating various embodiments of a protrusion piece according to the present disclosure, and FIG. 7 is a concept view illustrating a usage state of the teething growth device according to the present disclosure.

The teething growth device according to the present disclosure to implement the above-described characteristics includes a wrist band part 100 wound around a wrist of a baby, a body part 200 which is extended from the wrist band part 100 to be sucked or chewed by the baby, and has an inner space formed therein to allow a hand of the baby to be received therein, and a grip part 300 having both ends in contact with the body part 200 to be extended across the inner space of the body part 200. The teething growth device is characterized in that, when the wrist band part 100 is supported on the ground for storage, the body part 200 is not tilted due to the self-weight thereof and is vertically erected with respect to the ground.

More specifically, the wrist band part 100 is a part that is wound around the baby's wrist and is implemented in a circular, oval, or polygonal band shape. In addition, since the wrist band part 100 is formed with an elastic material, the wrist band part can be elastically deformed in response to a baby's relative thick wrist or an increase in the wrist according to the growth, and thus can be used without difficulty. In addition, the wrist band part 100 is characterized in that it can be worn on thick clothes without difficulty.

Hereinafter, a specific embodiment of the wrist band part 100 according to the present disclosure will be described with reference to the accompanying drawings.

As shown in FIG. 2, the wrist band part 100 includes a grip ring 110 a part of which is cut out to allow the baby's wrist to pass therethrough, and a fastening means 120 for fastening or unfastening both ends of the grip ring 110. In this case, the grip ring 110 may be implemented in various shapes to be wound around the baby's wrist, such as a circle, an oval, or a polygon. In the present embodiment, the grip ring 110 formed in the oval shape will be described for convenience of explanation. In addition, the grip ring 110 is characterized in that it is extended by elastic deformation to allow the baby's wrist to be introduced, and returns to its original state by elastic deformation to be kept wound around the wrist.

In addition, when the teething growth device is stored, a lower surface of the grip ring 110 is supported on the ground with an axial line of the grip ring 110 being placed in the vertical direction with respect to the ground.

In this case, since the grip ring 110 has a predetermined width in the vertical direction and has a part on a path cut, the grip ring can allow the baby's wrist to pass therethrough without interference. When the grip ring 110 is deformed in a shape illustrated by two-dot chain lines as shown in FIG. 4 and the baby's wrist is passed therethrough, both ends of the grip ring 110 return to their original positions due to the elastic restoring force. That is, a predetermined fixing force can be exerted only by the grip ring 110.

That is, when the grip ring 110 is applied to a baby having a relatively thick wrist, the grip ring 110 may be extended in response to the thick wrist and a fixing force is provided by the elastic restoring force. Therefore, the teething growth device does not slip from baby's body. In addition, in the case of a baby having a relatively thin wrist, both ends of the grip ring 110 are fastened to each other by the fastening member 120, and thus the teething growth device can be held on baby's body. As a result, since the teething growth device according to the present disclosure can be applied regardless of the thickness of the wrist, the teething growth device according to the present disclosure can be applied to a baby whose wrist gradually grows up without difficulty.

That is, since there is no need to manufacture the teething growth device in phases according to the thickness of baby's wrist, an inventory can be efficiently managed. Since there is no need to provide a plurality of teething growth devices according to the wrist of a growing baby, and only one teething growth device can be provided, an economical effect can be expected.

In addition, the grip ring 110 may have a first flange 111 and a second flange 112 formed at both ends thereof. The first flange 111 and the second flange 112 are extended forward from both ends of the grip ring 110 as long as a predetermined length, and are perpendicularly bent from both ends of the grip ring 110.

The fastening means 120 serves to fasten both ends of the grip ring 110, and for example, includes one or more fastening recesses 121 formed on one end of the grip ring 110, specifically, on the second flange 112, and one or more fastening pieces 122 formed on the other end of the grip ring 110, specifically, on the first flange 111, to be inserted into the fastening recess 121.

That is, when the fastening recess 121 and the fastening piece 122 are fastened to each other, the wrist band part 100 may be kept wound around the baby's wrist, and simultaneously, the wrist band part 111 can be prevented from being loosened arbitrarily. It should be noted that the fastening means 120 may be changed to a means for fastening by Velcro or a means for fastening by a buckle in addition to the above-described embodiment.

Accordingly, since the wrist band part 100 always grips the baby's wrist, the device can be always held on the baby's body even when the baby falls asleep using the teething growth device or loses the grip part 300 that the baby has gripped. Therefore, the baby does not awake from the sleep or does not burst into tears.

The teething growth device according to the present disclosure has a function of always maintaining the grip ring 110 of the wrist band part 110 in the oval shape, in addition to the function of having the grip ring wound around the baby's wrist. Therefore, the teething growth device can be erected on the ground for storage as shown in FIGS. 4 and 5. That is, when being applied to the baby, the wrist band part 100 is used as a fixing means for fixing the teething growth device to the baby's body, and also, is used to allow the teething growth device to be vertically erected with respect to the ground to prevent the body part 220, which will be described below, from being in contact with the ground and being contaminated when it is stored.

The body part 200 includes a support piece 210 extended upward along the axial direction of the grip ring 110 and formed in the shape of an inverted U, and a protruding piece 220 formed on an outer circumference of the support piece 210 and having a plurality of stimulus projections 221 protruding therefrom to stimulate the periphery of the baby's mouth.

In this case, the body part 200 is a part that is directly inserted into the baby's mouth, and is sucked, chewed, and bitten by the baby, such that itching in the mouth can be solved and the baby is exposed to various stimuli and thus is provided with pleasure.

More specifically, the support piece 210 forms an overall frame of the body part 200, and continuously surrounds the left, right, and upper sides of the baby's hand while opening the back and the palm of the baby's hand, thereby serving to prevent the baby's mouth from approaching the baby's hand.

In other words, the support piece 210 is formed in a substantially inverted U shape to provide a shielding operation to prevent the baby from sucking, chewing, and biting baby's finger, and to open the back and the palm of the baby's hand.

In addition, the support piece 210 is implemented to have a width in the forward and backward direction gradually reduced toward the upper portion, such that the baby can be provided with various pleasures and tactile sensations when chewing and biting the support piece 210 having different thicknesses.

When the baby grows up while having the habit of sucking fingers during the oral phase, there may be a problem that the oral habits which may cause functional disorders develop. Finger sucking stop gloves for covering baby's hand to prevent the habit of sucking fingers are disclosed. However, since the finger sucking stop glove is shaped to surround the entirety of baby's hand, babies may complain of constriction when wearing it or the glove is not breathable, and there is a demerit that constriction is caused when the baby wears the glove.

However, the teething growth device according to the present disclosure has the support piece 210 formed in the shape to completely open the back and the palm of the baby's hand while continuously surrounding the left, right, upper sides of the baby's hand, such that the baby can be prevented from sucking baby's finger, and simultaneously, can be induced to suck only the protruding piece 220, and, also, problems of the lack of breathableness and of discomfort when the device is worn can be solved.

In addition, it is preferable that both ends of the support piece 210 are positioned at quadrant points of the grip ring 110 symmetrical to each other as shown in FIG. 4. That is, when the teething growth device according to the present disclosure is stored while being supported on the ground, the center of gravity may be induced to the center of the grip ring 110, such that the teething growth device can be prevented from being easily titled.

Various engraved patterns may be formed on the surface of the support piece 210 to arouse baby's interest.

The protruding piece 220 may protrude from the support piece 210 to the outside to induce the baby to suck, chew, and bite only the protruding piece 220. All parts of the device can be sucked, chewed, and bitten as described above, but it is preferable to induce the baby to suck, chew, and bite only the protruding piece 220.

In this case, a plurality of protruding pieces 220 may be alternately formed along the path of the support piece 210, and their shapes are not limited.

As an embodiment of the protruding piece 220, a plate-shaped protruding piece 220 having a predetermined width in the forward and backward direction will be described for example.

When the baby puts the protruding piece 220 into the mouth and sucks, chews, and bites it, secretions such as saliva may continuously come. In this case, as shown in FIG. 5, it is preferable to form a stepped portion between the protruding piece 220 and the support piece 210 by making a width W2 of the protruding piece 220 in the forward and backward direction smaller than a width W1 of the support piece 210 in the forward and backward direction, to prevent the secretions from entering the inner space of the body part 200.

In other words, the secretions are blocked from flowing into the inner space of the body part 220, that is, the baby's hand, due to the presence of the stepped portion, and remain on the outer surface of the support piece 210.

Accordingly, the parent does not have to wipe the baby's hand exposed to the secretions, and has only to slightly wipe the secretions remaining on the support piece 210. Therefore, sanitation problems can be easily solved.

In addition, the support piece 210 serves as a stopper to prevent the protruding piece 220 from being swallowed behind the baby's throat and causing the baby to vomit, or to prevent the pharyngeal mucosa from being damaged when the baby sucks, chews, and bites the protruding piece 220.

It is noted that the protruding piece 220 is formed in various shapes as shown in FIG. 6, such as a ring shape (shown in FIG. 6A), a toothbrush shape (shown in FIG. 6B), a pacifier shape (shown in FIG. 6C), a cylinder shape (shown in FIG. 6D), an arc shape corresponding to gums (shown in FIG. 6E), and a hemispheric shape (shown in FIG. 6F).

The grip part 300 is a part that is gripped by the baby with baby's hand and is formed in a bar shape having a circular or polygonal cross section. A predetermined curvature may be applied in the longitudinal direction if necessary.

In addition, the grip part 300 has a plurality of grip protrusions 310 formed thereon in the longitudinal direction and corresponding to bottom surfaces of the fingers when the baby grips the grip part 300.

It is preferable that the grip protrusions 310 are formed on points corresponding to spaces between the fingers when the baby grips the grip part 300. In this case, the grip protrusions 310 fill the spaces between the baby's fingers, such that the baby can securely grip the grip part 300 even if the baby's griping force is somewhat weak. To enhance the gripping force, knurls may be formed along the outer circumference of the grip part 300.

Hereinafter, an example of wearing the teething growth device according to the present disclosure on the baby's wrist will be described.

First, the grip ring 110 is opened by spreading out both ends of the grip ring 110 in the shape illustrated by two-dot chain lines shown in FIG. 4, and then, the baby's wrist is placed inside the grip ring 110. In this case, when the baby's wrist is thicker than the inner circumference of the grip ring 110, the inner circumference of the grip ring 110 surrounds the baby's wrist and is maintained. When the baby's wrist is thinner than the inner circumference of the grip ring 110, both ends of the grip ring 110 are fastened to each other through the fastening member 120, thereby closing the grip ring 110.

After the grip part 300 is gripped by the baby's hand first, the grip ring 110 may be opened by spreading out both ends of the grip ring 110 and then the baby's wrist may be placed.

That is, the baby's hand does not have to approach the teething growth device according to the present disclosure from the lower portion of the grip ring 110. Therefore, the mounting and dismounting method of the related-art teething growth device, which forcedly inserts baby's hand into the grip ring 110 or draws out therefrom, is enhanced. Accordingly, the teething growth device can be easily worn on the baby's wrist, and, even when the teething growth device is removed from the baby's hand during sleep, the teething growth device can be easily taken out without separate external force. Therefore, the baby can be prevented from whining when awaking from sleep.

The embodiments of the present disclosure described above are merely examples, and it will be understood by a person skilled in the art that various changes can be made therefrom and other equivalent embodiments are possible. Therefore, it will be understood that the present disclosure is not limited to the form mentioned in the detailed descriptions. Therefore, the scope of the technical protection of the present disclosure should be defined by the technical concept of the appended claims. In addition, it should be understood that the present disclosure includes the sprits of the present disclosure defined by the appended claims, and all variations, equivalents, and substitutes within the scope of the claims.

What is claimed is:

1. A teething growth device provided with a wrist band, the device comprising:

a wrist band part which is configured to be wound around a wrist of a baby;

a body part which is extended from the wrist band part to be sucked or chewed by the baby, and has an inner space formed therein to allow a hand of the baby to be received therein; and a grip part which has both ends in contact with the body part to be extended across the inner space of the body part, wherein the wrist band part comprises a grip ring, wherein a part of the grip ring is cut out to allow the wrist of the baby to pass therethrough, and the grip ring is extended by elastic deformation to allow the wrist of the baby to be introduced, and returns to its original state by elastic deformation to be kept wound around the wrist, the wrist band part further comprises a fastening means for fastening or unfastening both ends of the grip ring, the fastening means comprises:

one or more fastening recesses formed on one end of the grip ring; and one or more fastening pieces formed on the other end of the grip ring to be inserted into the fastening recess, and when the teething growth device is stored, a lower surface of the grip ring is supported on the ground with an axial line of the grip ring being placed in a vertical direction with respect to the ground, and the body part is not tilted due to a self-weight thereof and is vertically erected with respect to the ground.

2. The teething growth device of claim 1, wherein the body part comprises:

a support piece which is extended upward along an axial direction of the grip ring and is formed in the shape of an inverted U; and a protruding piece which is formed on an outer circumference of the support piece and has a plurality of stimulus projections protruding therefrom to stimulate the periphery of baby's mouth.

3. The teething growth device of claim 2, wherein a stepped portion is formed between the protruding piece and the support piece by making a width of the protruding piece in a forward and backward direction smaller than a width of the support piece in the forward and backward direction, to prevent secretions from entering the inner space of the body part.

4. The teething growth device of claim 1, wherein the grip part has a plurality of grip protrusions formed thereon in a longitudinal direction and corresponding to bottom surfaces of fingers when the baby grips the grip part.

* * * * *